US006024211A

United States Patent [19]

Johnston

[11] Patent Number: 6,024,211

[45] Date of Patent: Feb. 15, 2000

[54] PHOTO CONDOM PACKAGE

[76] Inventor: Gregory J. Johnston, 2218-109th Ave. NE., Bellevue, Wash. 98004

[21] Appl. No.: 09/175,829

[22] Filed: Oct. 20, 1998

[51] Int. Cl.[7] ..... B65D 85/08

[52] U.S. Cl. ..... 206/69; 206/37; 206/460; 206/775; 206/459.5

[58] Field of Search ..... 206/69, 37, 38, 206/459.5, 775, 769, 216, 460; 40/702, 704, 706, 725, 781, 790

[56] References Cited

U.S. PATENT DOCUMENTS

| | | | |
|---|---|---|---|
| 1,274,804 | 8/1918 | Spitzer | 206/38 |
| 2,739,401 | 3/1956 | Balter | 40/702 |
| 3,077,688 | 2/1963 | Friedman et al. | 40/702 |
| 3,188,762 | 6/1965 | Morrill | 40/702 |
| 3,442,414 | 5/1969 | Pelli | 206/38 |
| 4,301,919 | 11/1981 | Morgan | 206/233 |
| 4,805,820 | 2/1989 | Kearney et al. | 224/252 |
| 4,984,683 | 1/1991 | Eller | 206/38 |

*Primary Examiner*—Paul T. Sewell
*Assistant Examiner*—Nhan T. Lam
*Attorney, Agent, or Firm*—Dean A. Craine, P.S.

[57] ABSTRACT

A photo condom package including a planar front rear panels connected together by a middle tab. The middle tab is made of flexible material which enables it to act as a hinge so that the front and rear panels may be folded over to enclose around a condom wrapper in an outer package. An adhesive is provided on the inside surface of the front and rear panels thereby enabling them to adhere to the outer package. In one embodiment, a thin removable film is placed over the inside surfaces which is removed when applying the package to a condom. Formed on the front panel of the package is an opening. During assembly, a small photograph is placed over one surface of the condom. The front panel is then aligned over the condom so that the photograph may be seen through the opening. An optional information panel may be printed on the outside surface of the back panel which enables an individual to print personal information on the condom.

10 Claims, 1 Drawing Sheet

PHOTO CONDOM PACKAGE

BACKGROUND OF THE INVENTION

1. Field of the Invention

This invention relates to containers or packages and more particularly, to packages used to carry condoms.

2. Description of the Related Art

Condoms are the most recommended and widely used prophylactic. Typically, condoms are rolled into a ring structure and distributed in a sealed, airtight wrapper. The wrapper may then be carried in a person's pocket, wallet or purse.

Today, single individuals often have multiple sexual partners. Whether or not individuals become sexual partners, depends, of course, on their physical attractiveness to each other. Heretofore, individuals would initially meet where they would view each other, converse and exchange personal information. If an individual was physically attracted to another individual, the individual could verbally inform the other individual of his or her attraction.

A more convenient, subtle method to inform someone that an individual is attractive and interested in a sexual relationship with them is to hand them a condom with a photograph or personal information attached thereto.

SUMMARY OF THE INVENTION

It is an object of the invention to provide a package used to hold a condom.

It is another object of the invention to provide such a package also capable of carrying a photograph or personal information about the individual offering the condom.

It is a further object of the invention to provide such a package that is economical to manufacture and easy to use.

These objects are met by a package designed to carry or to be attached to a standard condom wrapper. The package includes a planar front panel and a planar rear panel connected together by a middle tab. The middle tab is made of flexible material which enables it to act as a hinge so that the front and rear panels may be folded over and enclosed around a condom wrapper. An adhesive means is provided on the inside surfaces of the front and rear panels thereby enabling them to temporarily adhere to the condom wrapper. In one embodiment, a thin removable film layer is placed over the inside surface of the front and rear panels which are selectively removed when applying the package to a condom.

Formed on the front panel of the package is an opening. During assembly, a small photograph may be placed over the surface of the condom wrapper. The thin film layers are removed and the front panel is then aligned over the condom wrapper so that the photograph may be seen through the opening. The rear panel is then folded over the back surface of the condom wrapper. An optional information panel may be printed on the outside surface of the back panel which enables an individual to print personal information.

DESCRIPTION OF THE PREFERRED EMBODIMENT(S)

Figure 1:
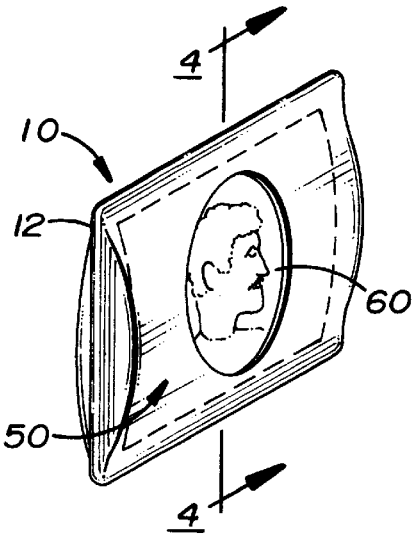
FIG. 1 is a perspective view of the photo condom package.

FIG. 1 is a perspective of the photo condom package, indicated generally by the number 10. In one embodiment, the package 10 is designed to enclosed around the outer wrapper of a typical condom 50. In another embodiment, shown in FIG. 5, the package 10' consists of a single planar structure designed to be placed directly over one surface of the outer wrapper of the condom 50.

Figure 2:
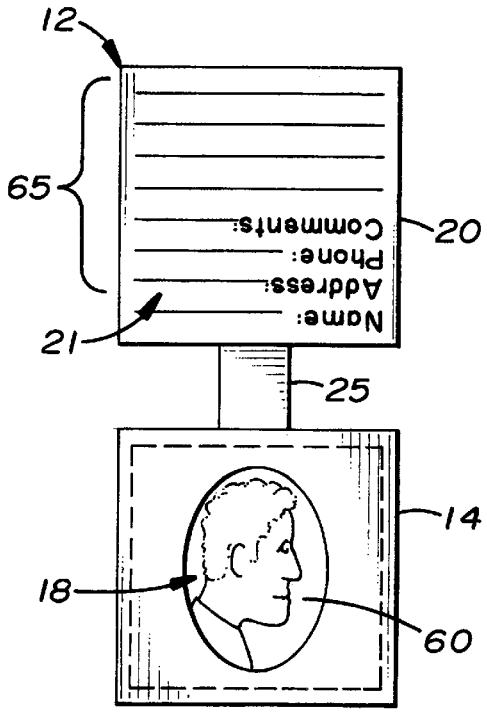
FIG. 2 is a front plan view of the main body of the photo condom package.
Figure 3:
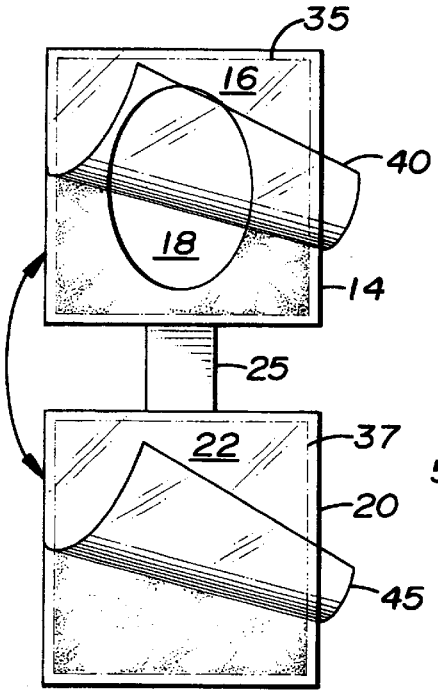
FIG. 3 is a rear plan view of the main body of the photo condom package.
Figure 4:
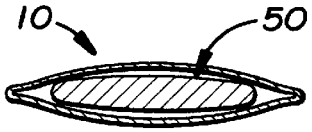
FIG. 4 is a sectional, side elevation view as seen along line 4—4 in FIG. 1.

As shown in FIGS. 2–4, the package 10 includes a planar front panel 14 and a planar rear panel 20 connected together by a longitudinally aligned middle tab 25. The middle tab 25 is made of flexible material which enables it to act as a hinge so that the frontal and rear panels 14, 20, respectively, may be folded over and enclose the condom 50. Narrow adhesive layers 35 and 37 are manufactured on the inside surfaces 16, 22 of panels 14, 20 respectively, which enable the panels 14, 20 to attach to the sides of the condom 50. Thin removable films 40 and 45 are disposed over the inside surfaces 16, 22 respectively, which are selectively removed when applying the package 10 to a condom 50.

Formed on the front panel 14 is an opening 18. During assembly, a small photograph 60 is placed over the inside surface 16 of the front panel 14 so that the image on the photograph 60 may be seen through the opening 18. In the embodiment shown in the accompanying drawings, the opening 18 is oval. It should be understood however, that the opening 18 can be any shape necessary to allow the image to be seen. An optional information panel 65 may be printed on the outside surface 21 of the back panel 20 which enables an individual to print personal information on the package 10.

Figure 5:
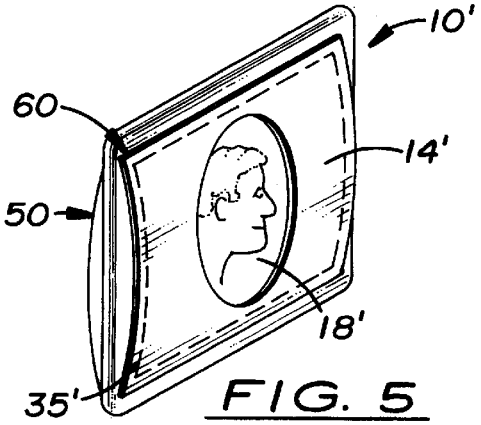
FIG. 5 is a perspective view of another embodiment of the photo condom package.

In FIG. 5, the package 10' includes a front panel 14' with an opening 18 formed thereon. An outer adhesive layer 35, a photograph 60 attached to a typical condom 50.

In the preferred embodiment, the photo condom package is made of paper or similar material.

In compliance with the statute, the invention, described herein, has been described in language more or less specific as to structural features. It should be understood, however, the invention is not limited to the specific features shown, since the means and construction shown comprised only the preferred embodiments for putting the invention into effect. The invention is, therefore, claimed in any of its forms or modifications within the legitimate and valid scope of the amended claims, appropriately interpreted in accordance with the doctrine of equivalents.

I claim:

1. A photo condom package, comprising:

a. a condom having an outer covering;

b. a package having a front panel being substantially the same size as said outer covering of said condom, said front panel having a viewing opening formed thereon;

c. an attachment means capable of attaching said front panel to said condom; and d. a photograph inserted behind said viewing opening capable of being viewed when said front panel is attached to said condom.

2. A photo condom package, as recited in claim 1, further including a rear panel, said rear panel being substantially the same size as said outer covering of said condom and pivotally attached to said front panel.

3. A photo condom package, as recited in claim 2, further including a flexible middle section disposed between said front panel and said rear panel.

4. A photo condom package, as recited in claim 2, further including an information space provided on said rear panel thereby enabling an individual to print personal information thereon.

5. A photo condom package, as recited in claim 2 further including an attachment means capable of attaching said rear panel to said outer covering of said condom.

6. A photo condom package, as recited in claim 1 wherein said attachment means is an adhesive layer on said front panel enabling said front panel to be attached to said condom.

7. A photo condom package, comprising:

a. a condom having an outer covering;

b. a package including a front panel and a rear panel being substantially the same size as said outer covering of said condom, said rear panel being pivotally attached to said front panel, and said front panel having a viewing opening formed thereon;

c. a photograph inserted behind said viewing opening capable of being viewed when said front panel is attached to said condom; and d. wherein said condom is disposed between said front and rear panels.

8. A photo condom package, as recited in claim 7 further including and an attachment means to attach said front and rear panels to said outer covering of said condom.

9. A photo condom package, as recited in claim 8 further including a flexible middle section disposed between said front and said rear panels.

10. A photo condom package, as recited in claim 7, further including an information space provided on said rear panel thereby establishing an individual to print personal information.

* * * * *